US008217741B1

(12) United States Patent
Patterson

(10) Patent No.: US 8,217,741 B1
(45) Date of Patent: Jul. 10, 2012

(54) MAGNETICALLY LOADED ELECTROMECHANICAL SWITCHES

(76) Inventor: Paul D. Patterson, Beaverton, OR (US)

( * ) Notice: Subject to any disclaimer, the term of this patent is extended or adjusted under 35 U.S.C. 154(b) by 77 days.

(21) Appl. No.: 12/860,008

(22) Filed: Aug. 20, 2010

Related U.S. Application Data

(60) Provisional application No. 61/237,114, filed on Aug. 26, 2009.

(51) Int. Cl.
*H01H 9/00* (2006.01)

(52) U.S. Cl. ..... 335/179; 335/205

(58) Field of Classification Search ..... 335/179
See application file for complete search history.

(56) References Cited

U.S. PATENT DOCUMENTS 4,625,194 A * 11/1986 Held ..... 335/271
7,388,461 B2 * 6/2008 Ryuen et al. ..... 335/251

* cited by examiner

*Primary Examiner* — Elvin G Enad
*Assistant Examiner* — Lisa Homza
(74) *Attorney, Agent, or Firm* — Maschoff Gilmore & Israelsen

(57) ABSTRACT

A switching device is provided. An electromechanical switch controls rotation and/or lateral displacement of a core inside a housing with a magnetic field. The core is magnetically aligned by the magnetic relationship between the core and the housing. An energizing device generates a magnetic field that is sufficiently strong to realign the core with the generated magnetic field. As a result, the core switches to an energized state. When the generated magnetic field is removed, the core switches back to the natural state.

23 Claims, 5 Drawing Sheets

3-Way example (energized)

MAGNETICALLY LOADED ELECTROMECHANICAL SWITCHES

CROSS-REFERENCE TO RELATED APPLICATIONS

This application claims the benefit of U.S. Provisional Application Ser. No. 61/237,114 filed Aug. 26, 2009 and entitled MAGNETICALLY LOADED ELECTROMECHANICAL SWITCHES, which application is incorporated by reference in its entirety.

BACKGROUND OF THE INVENTION

1. The Field of the Invention

Embodiments of the invention relate generally to electromechanical switches. More particularly, embodiments of the invention relate to the control of fluidic, pneumatic, electrical and optical switching devices with electromechanical switches.

2. The Relevant Technology

Electronically controlled switches utilize some form of electromagnetic design to generate a change in state for a specific application. These designs commonly include a coil for electronic control, a spring to assist in either closing or opening a point of control, and various designs for the point of control. The point of control for switches in electrical applications commonly includes contacts, while a port hole with some form of plugging mechanism is the point of control for valves and a lens assembly is the point of control for optical switches.

The operation of conventional switches often involves the use of a direct solenoid coil around a core which opens or closes the valve as energy is added or removed from the coil. Some MEMs (Micro-Electro-Mechanical System) designs utilize a cavity squeezing effect, whereby applying energy to a piezo material results in the closure of a cavity or diaphragm.

Currently, springs and hinge mechanism designs often assist in the operation of switches used in valve applications. Some switches have a port hole which is sealed by placing a compliant material over the port hole. Unfortunately, these springs and hinge mechanisms place additional load demands upon the structure. To overcome these demands of the springs and hinge mechanisms, higher magnetic forces are required to operate the switch.

In addition, the switches are often subject to wear and tear. Many valve seats, for example, have a conically shaped needle such that insertion into a conical shaped seat will result in a seal. In most of these designs, any misalignment occurring by virtue of inherent manufacturing tolerances must be compensated for by using relatively stronger springs to forcibly urge the valve design into a fully seated condition. Misalignment can also cause leaking at the valve seat or binding of the mechanical structure.

Each of these conditions place additional demands upon the electromagnet and increase manufacturing costs. Additionally, valve materials used for sealing are under load conditions which increase wear with increased operation. It is desirable, from a cost standpoint, to limit the use of materials in the switches. More specifically, the conductors utilized in switches are generally of a highly conductive material, such as copper or aluminum, which tend to be expensive. It would be advantageous to reduce the materials used (at least in terms of size and/or quantity), power, and cost while maintaining or increasing performance of switches including electromechanical switches.

BRIEF DESCRIPTION OF THE DRAWINGS

To further clarify at least some of the advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Embodiments of the invention relate to switches including electromechanical switches that are compact, reliable, fast operating, capable of being inexpensively manufactured and/or exhibit long operational lifetimes. From a cost, power and size standpoint, embodiments of the invention reduce or minimize the structural demands upon the switch, compared at least to conventional switches. Reducing the load demands in an electromagnetic switch, for example, can aid in minimizing the number of ampere-turns required to operate an electromagnet in the switch. Advantageously, the amount of material required for the switch can also be reduced. Further, embodiments of the invention relate to a switch requiring very low power to operate and having a reduced number of components.

The switches or switching devices disclosed herein, including electromechanical switches, can be used at least in fluidic, electrical, pneumatic, and/or optical applications. Generally, an electromechanical switch is formed from a magnetically loaded material placed into a ring and plug configuration. A coil is then attached to provide a magnetic field to operate the switching device.

Figure 1:
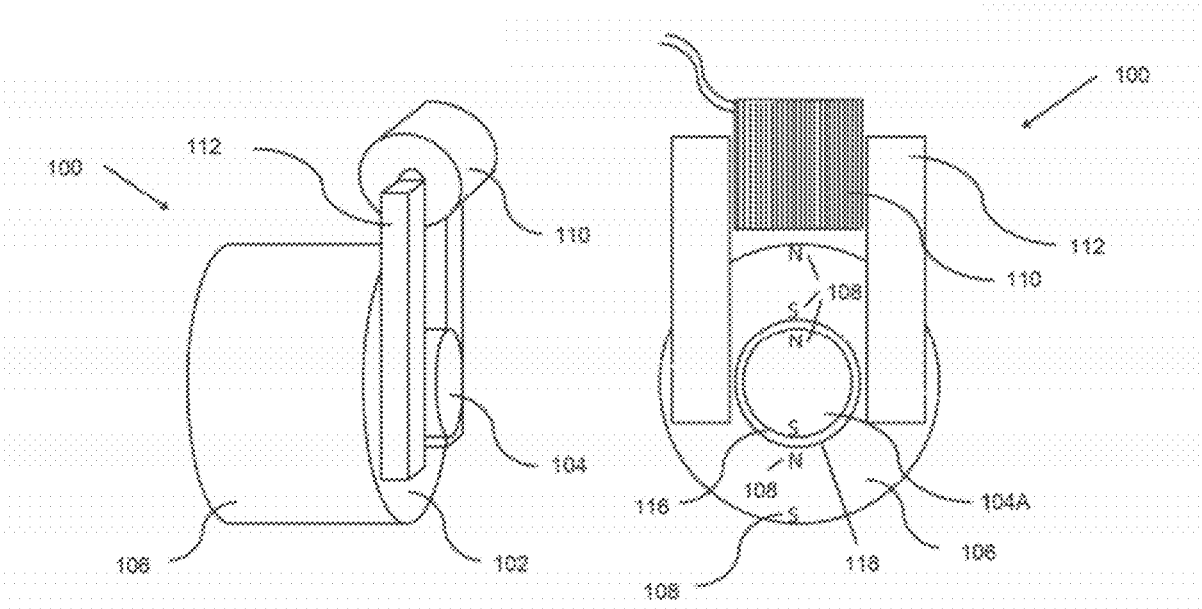
FIG. 1 illustrates a perspective view and a side view of one embodiment of a switch in a natural or non-energized state.

FIG. 1 illustrates one example of a switching device 100 including a perspective view and a side view of the switching device. The switching device includes a body 102 that includes a core 104 and a housing 106. In one example, materials for both the core 104 and the housing 106 include a magnetic material or a material which contains material that can be magnetized, such as injection moldable plastic containing magnetic material. Alnico, neodymium, and samarium cobalt are examples of materials. Injected molding polymers can often be filled to a percentage based on desired material properties.

The housing 106 has an exterior surface or perimeter whose shape can vary. For example, a shape of the exterior surface can be varied according to the use of the switching device 100. The exterior surface (and other features) may be shaped to fit in a particular location of a device or product.

The housing 106 typically includes a cavity 118 that is shaped to receive the core 104. Typically, the cavity 118 has a circular cross section and the core 104 has a circular cross section. The cross section of the core 104 is typically less than the cross section of the cavity 118, thus allowing the core 104 to fit within the cavity 118.

Figure 8:
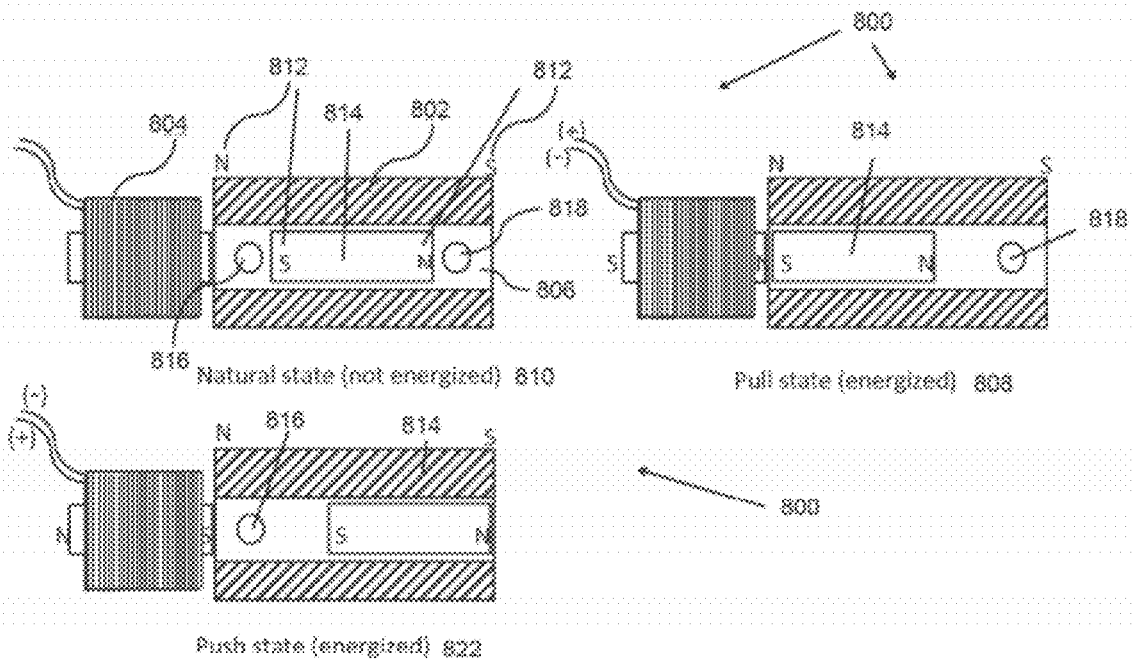
FIG. 8 illustrates an example of a switch that uses at least lateral translational switching action.

Alternatively, the relationship between the housing 106 and the core 104 can take other configurations. In one example, the housing 106 may be ring shaped with a cavity 118 that may be occupied by the core 104. In this example, the core 104 may be viewed as a plug that substantially fills the hole or cavity 118 of the housing 106. As illustrated in FIG. 8, however, the core may not completely fill the cavity but may be allowed to translate laterally within the cavity. More specifically, a length of the core 104 relative to a length of the cavity 118 can vary. As discussed in more detail herein, the differences in length can be used to achieve one or more different states of the switching device 100.

However, the cross sectional area of the housing 106 at the cavity 118 is substantially filled by the core 104—thus the core 104 can be viewed as a plug in this sense. As discussed in more detail herein, the core 104 can be moved laterally within the cavity 118. The core 104 may have a length that is less than a length of the cavity, more than the length of the cavity or the same as the length of the cavity.

In an alternative embodiment, the relationship of the cavity in the housing 106 and the external shape of the core 104 can vary and may not correspond to one another. For example, the cavity 118 and the core 104 can each have a conical shape. In another example, the cavity 118 may be cylindrical or tubular while the shape of the core 104 may be partially tubular and partially conical. The tubular portion of the core 104 may keep the core 104 aligned in the cavity 118 while the conical portion of the core 104 may be used as a point of control of the switching device 100.

The shape of the cavity 118 in the housing 106 and the shape of the core 104 allow the core to provide a contactless interface such that the switch can be sealed without contact in at least one embodiment. For instance, the core 104 and the housing 106 are configured to allow the core 104 to rotate within the cavity 118. The surface of the core 104 is thus adjacent an interior wall of the housing that defines the cavity 118. The magnetic fields of the core 104 and the housing 106, however, allow the core 104 to self align according to the magnetic poles. As discussed in more detail below, this allows the switching device 100 to provide a contactless seal, by way of example only and not limitation, in fluidic and pneumatic applications.

Advantageously, the magnetic fields can be configured to provide a substantially contactless interface. As discussed below, a gap 116 may be present around the circumference of the core 104. This contactless interface between the core 104 and the housing 106 allows the core 104 to rotate within the housing 106 (or in the cavity 118) with substantially less friction.

Figure 2:
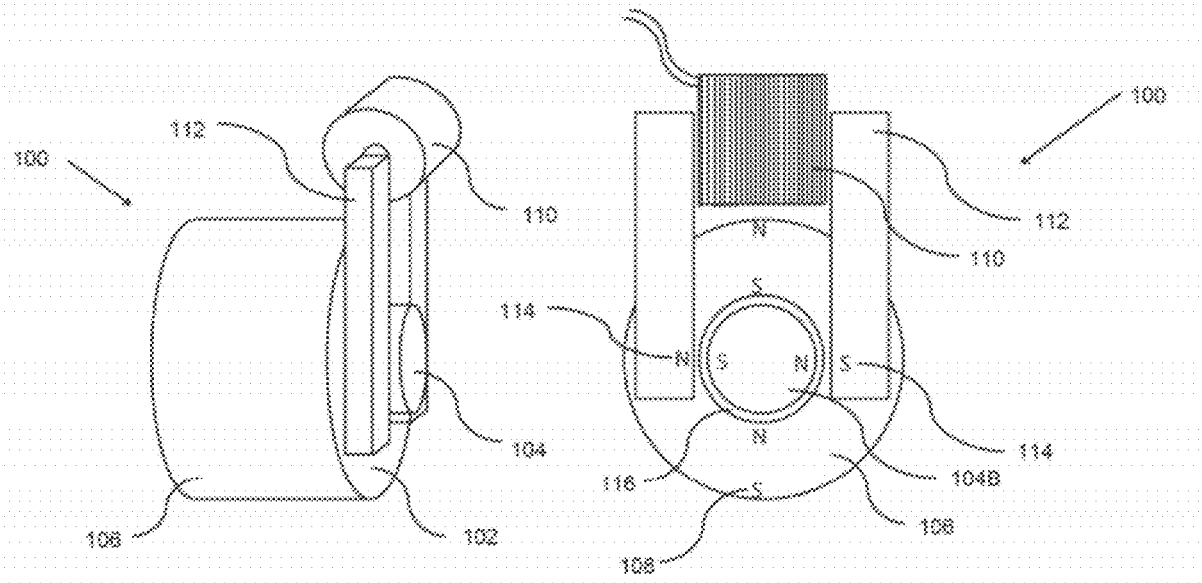
FIG. 2 illustrates a perspective view and a side view of the switch in an energized state.

The core 104 and the housing 106 naturally orient themselves according to aligning poles 108, identified by North (N) and South (S) symbols in FIGS. 1 and 2. FIG. 1 illustrates the switch in a natural state, where the magnetic poles of the core 104 are attracted to the corresponding magnetic poles of the housing 106. In the natural state, the switching device 100 is generally not energized.

FIG. 1 further illustrates that the switching device 100 may include an armature 112 with a coil 110. The armature 112 and/or coil 110 are typically fixed to the housing 106 of the switching device 100. The connection can be, by way of example, mechanical fasteners (e.g., screws, bolts), epoxy, welding, and the like. The armature 112 and coil 110 are an example of an energizing device. The energizing device can control a position of the core within the cavity formed in the housing. The position can be controlled, by way of example, only, rotationally and/or laterally.

In one example, the armature 112 and/or coil 110 may include a cap that is configured to engage with an end of the housing 106. The housing 106 may have a groove or other structure that engages with complementary structure in the cap to secure the cap, and thus the coil 110 and armature 112 in place. The complementary engagement structures may also have rotational structure to ensure that the placement of the armature 112 relative to the core 104 and housing 106 is correct to ensure proper operation of the switching device 100. The armature 112 may also be attached to the housing 106 by a pressure sensitive adhesive, UV curing adhesive, and the like, placed between the housing 106 and the armature 112.

When the coil 110 is energized, North and South poles 114 can be created in the armature 112. The magnetic force generated by the coil 110 is preferably designed to overcome the magnetic energy required to retain the core in its natural state 104A. When the coil 110 is energized and the magnetic field of the armature 112 is sufficient, the core 104 rotates within the cavity 118 to an energized state 104B, as illustrated in FIG. 2.

In the energized state 104B, the magnetic poles of the core 104 are aligned with the magnetic poles 114 generated within the armature 112, as illustrated in FIG. 2. When energy to the coil 110 is removed, thereby removing the magnetic field generated by the armature 112, the magnetic fields of the core 104 and the housing 106 cause the core 104 to return to the natural state 104A, as illustrated in FIG. 1. When the energy is removed from the coil 110, the core 104 can rotate in either direction to return to the natural state 104A.

In one example, the housing 106 is typically held in location or fixed while the core 104 is able to alter its position relative to the magnetic field 114 generated in the armature 112. Thus, the body 102 or the housing 106 may include means for connecting to a surface of an apparatus. Alternatively, the core 104 may be fixed while the housing 106 is free to move (e.g., rotate). In this example, the core 104 is configured to rotate within the housing 106 in response to the magnetic fields being applied as discussed herein.

Further, embodiments of the invention may contemplate multiple coils and multiple armatures to rotate the core 104 by specific amounts. For example, the various armatures can be arranged to rotate the core 104, by way of example and not limitation, in steps (30 degree steps, 45 degree steps, etc.). Embodiments of the invention further contemplate both rotational movement and/or translational movement of the core 104 relative to the housing 106.

For example, one coil/armature may rotate the core 104 (or otherwise move or translate the core 104) by 45 degrees while another coil/armature, when energized, may rotate the core 104 by 90 degrees. One of skill in the art can appreciate that other movements or degrees of displacement or rotation can be achieved by the orientation of the coil/armature relative to the core 104 and housing 106. As previously mentioned, the core 104 can rotate in either direction according to the magnetic force being applied.

In another embodiment, the energy applied to the coil 110 can be controlled. As illustrated in FIGS. 1 and 2, the armature 112 is configured to rotate the core 104 approximately 90 degrees. By varying the energy applied to the coil 110, the rotation of the core 104 can be controlled. As a result, the core 104 can be caused to rotate to any position between 0 and about 90 degrees. In some instances, this may allow the switching device 100 to control, by way of example only, fluid flow in a varying manner. Alternatively, the ability to variably control the rotation of the core 104 can allow the switching device 100 to provide multiple contact points for electrical connections at different positions. Thus, rotation of the core 104 (and/or of the housing 106) can be achieved using a variably energized coil and/or through the use of multiple armatures.

As previously stated, embodiments of the switching device 100 include multiple aligning poles 108, 114. Multiple aligning poles can create an indexing function and/or enhanced alignment. With no energy applied to the coil 110, the switch remains in its natural state 104A with the magnetic poles of the core 104 attracted to the corresponding magnetic poles within the housing 106. Thus, the switches or switching devices disclosed herein can automatically align themselves in a natural state 104A, move to an energized state such as energized state 104B and return themselves to their natural state after energy is removed. Because the core 104 may align itself within the housing 106, which may be circular in nature, the core 104 may be able to rotate about an axis that provides substantially frictionless rotation.

In one example, the core 104 may rotate without touching the interior wall of the housing 106. This contributes to the low power required to operate the electromechanical switch. More specifically, using current manufacturing methods, the gap 116 between the core 104 and the housing 106 can be controlled to tight tolerances. The nature of the magnetic forces in the switching device 100 results in a natural alignment of the core 104 to the center axis of rotation for the housing 106. This feature can be leveraged to create a low power precision switch or switching device for several applications.

Figure 3:
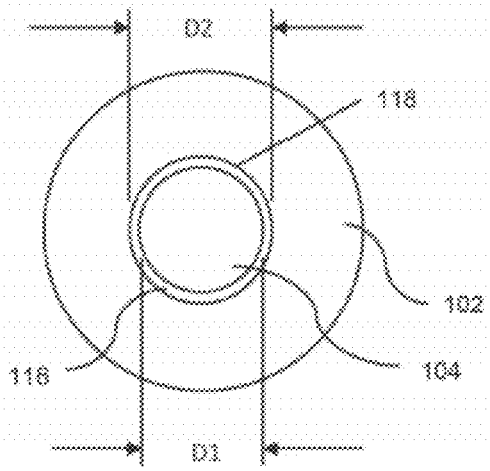
FIG. 3 illustrates a gap between a core and a housing of a switch.

For example, the switching device 100 may be employed in a gas valve application. In this example, the ability to provide tight manufacturing tolerances can prevent leakage of the gas from the switching device 100. For example, no leak will occur for all gasses, excluding hydrogen, if the gap 116 between the core 104 and the housing 106 can be controlled to the relationship 0.0001 inches$\leqq$D2-D1$\leqq$0.0003 inches as illustrated in FIG. 3. D2 is a diameter of the cavity in the housing 106 and D1 is a diameter of the core 104 in this example. Due to the balanced magnetic forces that exist in the multiple poles of the switching device 100, the gap 116 will be uniform around the core 104 as it is naturally centered in the housing 106.

In one example of a fluidic application, the gap 116 can be manufactured to maintain the relationship of D2-D1 to be less than 0.0001 inches. The lower limit of 0.0001 inches is the maximum gap allowed to seal against hydrogen gas. All other gasses can usually be sealed by limiting the gap to a maximum of 0.0003 inches. For liquid applications, the viscosity of the fluid can be adjusted to prevent leakage or slow operation. Additionally, the active surfaces of the switching device (e.g., a valve) can be treated lyophobicly to prevent fluid from wicking into the gap 116.

Figure 4:
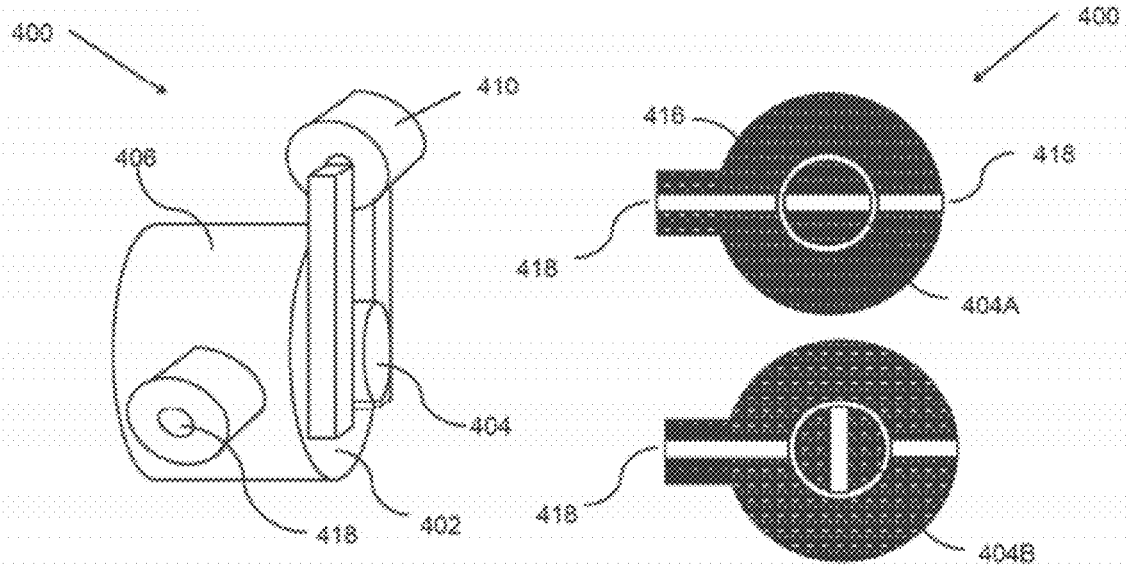
FIG. 4 illustrates a perspective view and a cross sectional view of a switch configured for a fluidic application.

FIG. 4 illustrates an example of an electromechanical switch 400 in a fluidic application (such as a gas) from a perspective view and in a cross sectional view along a port hole 418. The switch 400 is an example of the switching device 100 and includes a housing 402 and a core 404. In this example, the port hole 418 is formed (e.g., through the center) through the housing 406 and core 404. In this example, the port hole 418 runs substantially orthogonal to the axis of rotation of the core 404, although the port hole 418 can be arranged in another configuration and axis.

In a 'normally open' configuration of the switch 400, fluid can flow freely through the valve in the natural state 404A or energy off condition. In other words, fluid can flow through the port hole 418 because the core 404 is arranged to permit fluid flow through a bore or hole formed in the core 404.

When a coil 410 is energized, the core 404 is rotated 90 degrees in this example to the energized state 404B, thereby blocking the fluid flow through the switch 400.

For a normally closed configuration of the switch 400, the poles of the core 404 are offset 90 degrees relative to the poles of the core 404 in the normally open configuration of the switch 400, resulting in a power-off or natural state of closed. In other words, the orientation of the poles of the core 404 relative to the port hole 418 can determine whether the switch 400 (e.g, a valve) is open or closed when no energy is applied to the coil 410.

The size of the port hole 418 can vary according to a desired flow or flow rate. The flow rate can be controlled, for example, by a size of the bore or hole that forms the port hole 418.

Figure 5:
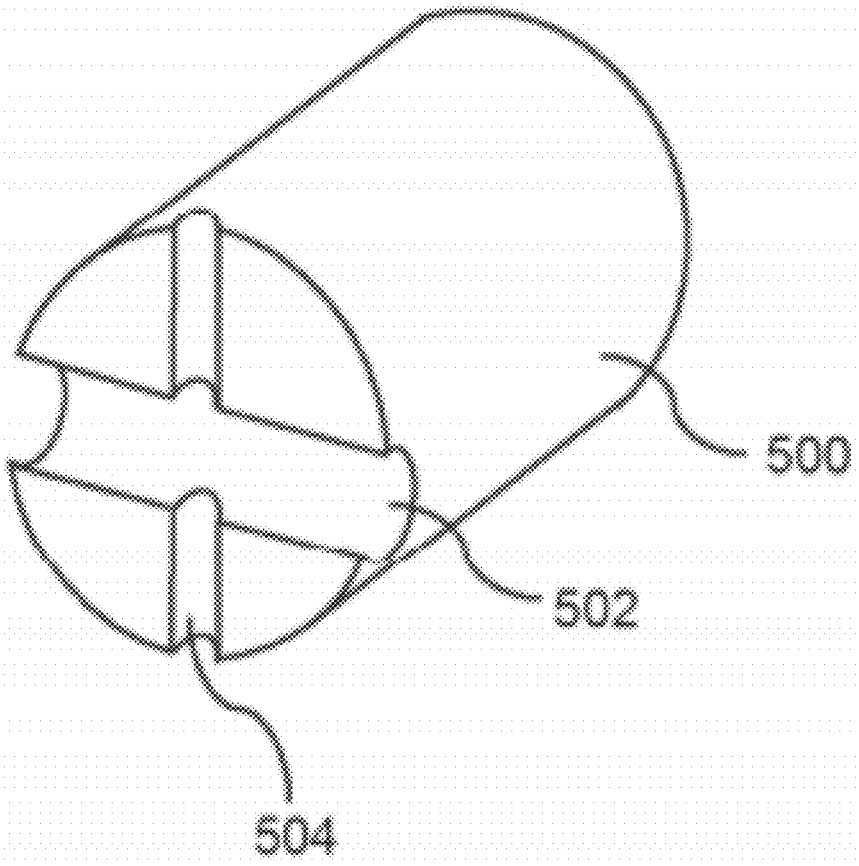
FIG. 5 illustrates a perspective view of a core with multiple ports formed therein.

FIG. 5 illustrates another example of a core 500 that can be used in embodiments of the switch or switching devices disclosed herein to control fluidic flow. The core 500 illustrated in FIG. 5 can provide a slow leak. In this example of the core 500, the core 500 may include a port 502 and a port 504. The port 502 has a larger cross sectional area than the port 504. As a result, the flow of fluid is different for the two port holes 502 and 504.

When a switch (e.g., the switch 400) is energized, for example, the fluid may flow freely through the port 502. When energy is removed from the switch, then the switch provides a slow leak through the port 504 and fluid flow is more restricted compared to the port hole 502. This may be useful for various kinds of fluid including gaseous fluids and liquid fluids. The port 504, by way of example only, may have a diameter on the order of 0.01 inches while the port 502 may have a larger diameter.

In addition, the ports 502 and 504 are typically substantially orthogonally positioned relative to each other in one example. Further, the fit or gap between the core 500 and the housing of the switch substantially is configured such that the fluid does not typically leak from the port that is not aligned. For example, when the port 504 is aligned for fluid flow, the interface between the port 502 and the interior wall of the housing prevents additional fluid leak at that point from the port 502.

Figure 6:
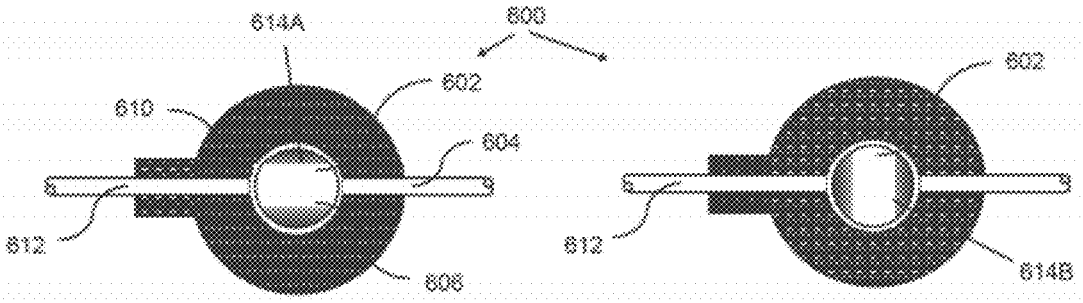
FIG. 6 illustrates a cross sectional view of a switch configured for an optical application.

FIG. 6 illustrates an example of a switch 600 in an optical application. The switch 600 is an example of the switching device 100. In this example, a spherical lens 602 (or other optical element) can be attached to the center of axis on the core 606. An optical fiber 612 can be inserted into the housing 610 of the switch 600 similar to the ports on the valve design described previously. Energizing the coil of the switch 600 rotates the lens 602 from position 614A to position 614B, blocking the light traveling in the optical fiber 612. The magnetic forces naturally position the core 606 to the ideal center of rotation, significantly reducing manufacturing costs associated with alignment. As previously stated, the lens 602 or other optical assembly can be arranged in the core 606 such that the energized state of the coil can allow or block light.

Figure 7:
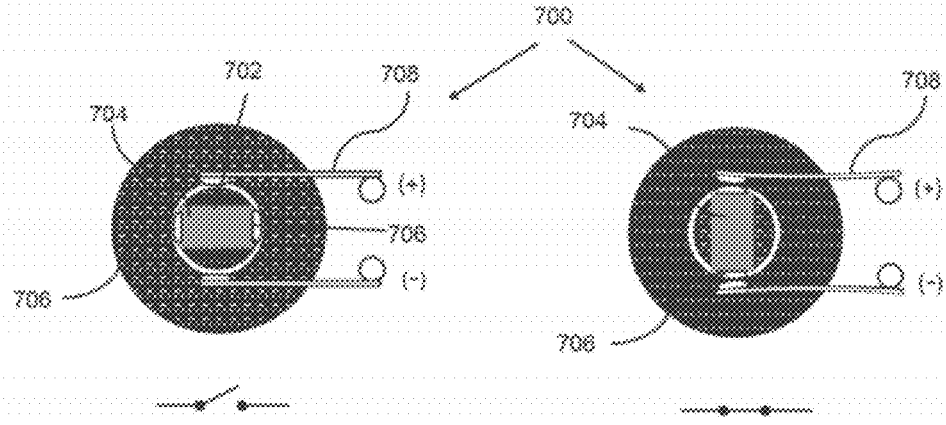
FIG. 7 illustrates a cross sectional view of a switch configured for electrical application.

FIG. 7 illustrates an example of a switch 700 in an electrical application. The switch 700 is an example of the switching device 100. In an electrical switch application, a core 702 can contain a buss type conductor 704 or similar, with or without a contact(s) 706. As the core 702 is rotated, as previously described, the contacts 706 will engage with a desired wiping action or other type of mechanical engagement to establish an electrical connection. Similar to a motor stator, an electrical switch may include a spring 708 design to engage and hold the contacts 706 closed. Such a design may require higher power to operate the switch 700. Spring designs can be created that will either require or not require power to maintain electrical connection.

FIG. 8 illustrates another example of a switch 800, which is an example of the switching device 100. The switch 800 includes a housing 802 and a core 814. In this example, however, the core 814 has a length that allows the core 814 to translate laterally within the cavity of the housing 802. The magnetic fields are at the ends of the housing 802 and core 814 in this example, as illustrated by magnetic fields 812.

When the coil and armature (collectively 804) is not energized, the core 814 is in a natural state 810 within the housing 802. Because the core 814 has a shorter length compared to a length of the cavity in the housing 802, the natural state 810 of the core 814 is naturally centered in the cavity of the housing 802 according to the magnetic fields 812 of the switch 800.

A pull state 808 is illustrated when the coil 804 is energized in FIG. 8. The switch 800 can also be configured to enter a push state 822. In the pull state 808, the magnetic field generated by the coil 804 attracts the core 814 and overcome the magnetic fields of the housing 802 and the core 814 to pull the core 804 towards the coil/armature 804 end of the switch 800. Of course, the coil/armature 804 can also be configured to generate a magnetic field to push the core 814 away as illustrated by the push state 822.

The switch 800 illustrated in FIG. 8 may also have a gap as previously described and may be operated in a fluidic application, pneumatic application, electrical application, optical application, and the like. Specifically, the items 816 and 818 can be contacts, ports, optical fibers, and the like or any combination thereof. The core 814 may be similarly configured as previously described herein with optical elements, contacts, holes, and the like. One or more additional items (port, contact, etc.) may be behind the core 814.

Although FIG. 8 illustrates that the core 814 is between the items 816 and 818, the core 814 may have a length (or the items 816 and 818 may be positioned) such that at least one is covered by the core 814 when in the natural state 810. One of skill in the art can appreciate, with the benefit of the present disclosure, that the items 816 and 818 can be configured such that the core 814 may by located to cover or contact or interface with one or more of the items in any of the natural or energized states.

Further, the field generated by the coil/armature 804 can be reversed such that at least three states are possible. As a result, both items 816 and 818 could be open in the natural state or one of the items 816 and 818 can be covered as illustrated by the energized states.

Figure 9:
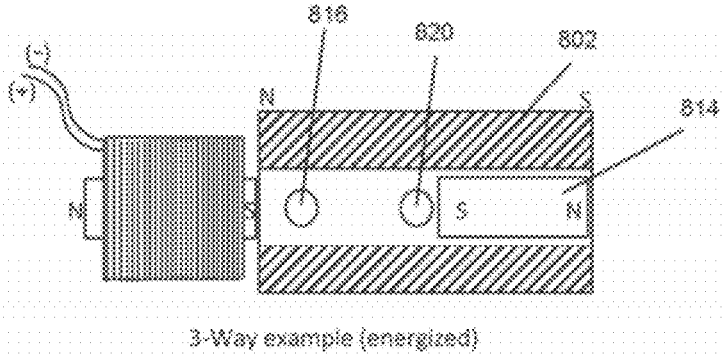
FIG. 9 illustrates an example of a three way switch with a core that translates at least laterally.

FIG. 9 illustrates an example of a switch 900 that can be a three way switch. The switch 900 is an example of the switch 800. By energizing the switch 900 to push or pull the core 814 to different locations within the cavity of the core 802, at least three states can be achieved with the switch in FIG. 9. The items 816, 818, and 820 can be connected in different configurations by the core 814. For example, the core 814 can connect items 820 and 818, connect items 816 and 820, or not connect any of the items 816, 818, and 820.

The switches or switching devices described herein may not have parts that degrade or wear due to port sealing load condition (e.g., loads that occur when a port is sealed such as mechanical binding, etc.). In some embodiments, the interface between the core and the housing is contactless and the core is automatically aligned by the magnetic fields.

In addition, the switches have minimal or no drag, minimal structural loading, are frictionless or substantially frictionless, and can be operated in low power or ultra low power modes. Further, the switches self align using the magnetic field. Also, the switches can be manufactured less expensively. Some embodiments of the invention eliminate springs that increase the electromagnetic forces required to open or close the switch.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An switching device comprising:

a housing having a body defining a cavity formed therein with a circular cross-sectional profile and with a first cavity lateral axis that intersects and is orthogonal to a second cavity lateral axis on the cross-sectional profile and with a centered cavity longitudinal axis that intersects and is orthogonal to the first cavity lateral axis and second cavity lateral axis, wherein the first cavity lateral axis intersects the housing body at opposite housing magnetic poles with respect to the centered longitudinal axis;

a core having a body with cross-sectional profile that is smaller than and matches the cavity cross-sectional profile placed in the cavity such that a centered core longitudinal axis aligns with the centered cavity longitudinal axis and that there is an annular gap between the core body and housing body, the core body having opposite core magnetic poles on a core lateral axis that are magnetically aligned with the housing magnetic poles when in a natural magnetic state;

an armature connected with the housing such that opposite armature magnetic poles are aligned with the second cavity lateral axis, wherein the core magnetic poles are magnetically aligned with the armature magnetic poles when in an energized magnetic state; and a coil wound around the armature between the opposite armature magnetic poles, wherein the coil generates a magnetic field in the armature that rotates the core from the natural magnetic state to the energized magnetic state when the coil is energized, wherein the core returns to the natural magnetic state when the coil is not energized.

2. The switching device of claim 1, wherein:

the housing is formed of a magnetic material;

the core is formed of the magnetic material; and the housing and the core are aligned to the natural magnetic state automatically by poles of the magnetic material.

3. The switching device of claim 2, wherein the magnetic field generated in the armature is sufficiently strong to move the core from the magnetic natural state to the energized magnetic state.

4. The switching device of claim 3, wherein the core rotates about 90 degrees when rotating from the natural magnetic state to the energized magnetic state.

5. The switching device of claim 1, further comprising a gap between the entire core and the housing, wherein the core centers itself within the cavity at the cavity longitudinal axis and facing surfaces the core and the housing are contactless in the natural magnetic state and energized magnetic state.

6. The switching device of claim 1, wherein the annular gap is within a range of about 0.0001 inches and 0.0003 inches.

7. The switching device of claim 1, wherein the annular gap is less than or equal to 0.0001 inches.

8. The switching device of claim 1, further comprising a housing port formed in the housing and aligned with a core port formed in the core when in either the natural magnetic state or the energized magnetic state and not aligned in the other magnetic state, wherein the housing port and core port are configured for one of a fluidic application, a pneumatic application, or an optical application.

9. The switching device of claim 8, wherein the core, when housing port and core port are not aligned, provides a contactless seal for the housing port.

10. The switching device of claim 8, further comprising an optical element disposed in the core port, wherein light passes through the core port in one of the natural state or the energized state.

11. The switching device of claim 8, wherein the core port is self-aligned with the housing port when in the natural state or when in the energized state.

12. The switching device of claim 1, wherein a surface of the core and an interior wall surface of the cavity of the housing are treated lyophobicly.

13. The switching device of claim 1, wherein the core comprises electrical contacts that electrically engage with corresponding electrical contacts mounted to the housing when the core is configured for an electrical application in at least one of the natural state or the energized state.

14. The switching device of claim 1, wherein a longitudinal length of the core is less than a longitudinal length of the housing, wherein the magnetic field can at least one of push or pull the core inside of the cavity.

15. A switching device comprising:

a housing having a body defining an elongate cavity formed therein with a circular cross-sectional profile and with a centered cavity longitudinal axis extending between opposite housing magnetic poles at opposite ends of the elongate cavity;

an elongate core having a body with cross-sectional profile that is smaller than and matches the cavity cross-sectional profile arranged in the cavity such that a centered core longitudinal axis aligns with the centered cavity longitudinal axis and that there is an annular gap between the core body and housing body, the core body having opposite core magnetic poles at opposite ends that are magnetically aligned with the housing magnetic poles such that the core is centered between the housing magnetic poles at a natural magnetic state position when in a natural magnetic state, the core being capable of translating along the centered cavity longitudinal axis to a pull magnetic state position and to an opposite push magnetic state position; and at least one energizing device adjacent to at least one end of the cavity of the housing and operably coupled with a first end of the core, wherein the energizing device controls a position of the core inside of the cavity, when the energizing device is not energized the core is at the natural magnetic state position, when the energizing device is energized to a pull energized state the core is in the pull magnetic state position proximal the energizing device, when the energizing device is energized to a push energized state the core is in the push magnetic state position distal the energizing device.

16. The switching device of claim 15, wherein the core comprises one of a fluidic element, an optical element, or an electrical element, wherein the energizing device controls the position of the core to change a state of the fluidic element, the optical element, or the electrical element.

17. The switching device of claim 15, wherein the core and the cavity each have a circular cross section, wherein the core has a contactless interface with the cavity.

18. The switching device of claim 15, wherein a length of the core is shorter than a length of the cavity.

19. The switching device of claim 15, wherein the energizing device energizes a coil to generate a magnetic field in an armature connected to the housing to overcome strength of the housing magnetic poles that naturally align the core and to move the core to pull magnetic state position or push magnetic state position within the cavity.

20. The switching device of claim 15, wherein the housing and the core comprise a magnetic material.

21. The switching device of claim 15, wherein the at least one energizing device is configured to move the core to multiple positions relative to the cavity.

22. The switching device of claim 15, wherein the core comprises multiple holes, each hole configured for a different flow rate of fluid through the switching device.

23. The switching device of claim 15, wherein at least one energizing device steps the core through multiple positions, each position corresponding to a different state.

* * * * *